United States Patent [19]

Higdon

[11] Patent Number: 4,657,091

[45] Date of Patent: Apr. 14, 1987

[54] DRILL BITS WITH CONE RETENTION MEANS

[76] Inventor: Robert Higdon, 3300 Pebblebrook, Seabrook, Tex. 77586

[21] Appl. No.: 730,550

[22] Filed: May 6, 1985

[51] Int. Cl.[4] ..... E21B 10/22

[52] U.S. Cl. ..... 175/229; 175/340; 175/371; 175/369; 384/93; 384/96

[58] Field of Search ..... 175/227, 228, 229, 369, 175/370, 371, 372; 308/6 A; 384/93, 94, 95, 96

[56] References Cited

U.S. PATENT DOCUMENTS 2,174,102 9/1939 Catland ..... 175/229

3,244,459 4/1966 Ortloff ..... 175/372

*Primary Examiner*—James A. Leppink

*Assistant Examiner*—Terry Lee Melius

*Attorney, Agent, or Firm*—Neal J. Mosely

[57] ABSTRACT

There is disclosed a drill bit which is connectable to the lower end of a rotary drill string for use in drilling oil and gas wells as drilling mud is circulated downward through the string, out the bit, and upwardly within the annulus between the string and well bore so as to remove cuttings therefrom. The bit has cones which are mounted for rotation about thrust bearings which extend inwardly from the lower ends of legs which depend from a shank at the upper end of the bit body which is attached to the drill string.

17 Claims, 14 Drawing Figures

DS
24
23
26
44
22
45
32
34
20
36
69
68
66
10
65
33
25
10
35
67
61
42
27
26
21
62
43
27
64
7
63
57
41
56
11
58
28
51
47
70
50
48
30
49
60
46
29
72
12
31

DRILL BITS WITH CONE RETENTION MEANS

This invention relates generally to drill bits connectable to the lower ends of rotary drill strings for use in drilling oil and gas wells as drilling mud is circulated downward through the string, out the bit, and upwardly within the annulus between the string and well bore so as to remove cuttings therefrom. More particularly, it relates to improvements in drill bits of this type having cones which are mounted for rotation about thrust bearings which extend inwardly from the lower ends of legs which depend from a shank at the upper end of the bit body which is attached to the drill string.

In conventional bits of this type, the cones are releasably retained or held on the thrust bearings by locking balls or split metal rings received within races and matching recesses formed in the inner and outer cylindrical bearing surfaces of the cone and journal bearing, respectively. More particularly, means are provided for inserting or removing these retaining parts so that the cones may be replaced or repaired from time to time. However, the locking balls and rings are subject to frequent breakage due to high temperatures from uneven wear due to very high thrust loads on the cones, thus requiring frequent replacement of the entire bit body. Also, the races and recesses for the balls and rings reduce the bearing areas of the cone and journal bearing as well as the strength of the cones by reducing their thickness in the area of the races and recesses.

To compensate for this loss of journal bearing area, bits of this type are often provided with "nose" bearings in the form of cylindrical projections on the ends of the journal bearings which are received within cylindrical bearing surfaces in the inner ends of the cone recess. This, however, inherently reduces the end areas of the cones and journal bearings available for carrying thrust on the cone.

It's also conventional practice to lubricate the bearing surfaces between the cone and journal bearing by means of a lubricant introduced through an opening in the body into a reservoir leading to the surfaces. The lubricant is normally contained by means of electameric O-rings which surround the journal bearing surface to form a rotary or dynamic seal between it and the cone. More particularly, the lubricant is preferably maintained at well pressure to prevent the intrusion of well fluid by means of a "compensator" at the opening to the reservoir. However, these seal rings are highly susceptible to failure due to the high pressures and temperatures present in the well, particularly when drilling with oil base muds, thus requiring that the drill string be pulled to replace them when the lubricant which is lost. Even then, if the seal rings have failed, foreign substances in the drilling mud may get between and seriously damage the bearing surfaces.

Bits of this type are often made up of separate forgings each comprising a section of the shank and a leg on which a journal bearing is mounted, and welded to adjacent sections along the inner and outer edges of their adjacent sides, Because of their locations, these welds are difficult to form, particularly along the inner edges of the sections. Also, the welded side edges of the shank portions of the sections require substantial preparation prior to the forming of threads thereon for connecting the shank to the lower end of the drill string.

The cones of bits of this type which are used to drill in rock or other hard formations often have carbide inserts mounted in rows along high wear areas of the cone. Conventionally, these are press fitted into cylindrical holes in the outer side of the cone. To securely hold the inserts, the holes must be of substantial depth, which of course limits the diameter of the journal bearing about which the cone rotates.

An object of this invention is to provide a bit of this type in which the cones are held or retained on the journal bearings by means which does not limit the cylindrical bearing areas between them, and, more particularly which eliminates the need for "nose" bearings and thus provides greater thrust bearing areas.

Another object is to provide a bit of this type in which lubricant is caused to circulate between the bearing surfaces of the journal bearing and cone, and thus maintained at a cooler temperature as the cone rotates about the bearing during drilling.

Another objected is to provide a bit of the type described which makes it possible to accomplish both of the above described objects by a compact arrangement which requires substantially no modification of the overall shape and size of the thrust bearings and cones.

A farther object is to provide a bit of this type in which lubricant is contained between the bearing surfaces of the journals bearings and cones in such a manner as to require less repair or replacement of the seals therebetween, and, more particularly, without dynamic elastomeric seals.

Yet another object is to provide such a bit having a simple and inexpensive arrangement for insuring that foreign substances will not intrude between the lubricated bearing surfaces, even upon failure of the seals intended to contain the lubricant.

Still a further object is to provide a bit of this type in which the body is of a construction which is simpler to assemble, and which requires no special preparation for the shank threads, then the above mentioned bit body constructions.

Still another object is to provide a bit of this type in which carbide inserts for the cones are installed in holes in the cone which are of less depth, so that the journal bearings may be made of correspondingly greater diameters.

These and other objects are accomplished, in accordance with the illustrated embodiment of the present invention, by a drill bit of the type described in which a chamber formed between walls of the journal bearing and cone is filled, filled with liquid from which air has been displaced to provide a liquid lock which holds the cone on the journal bearing. As a consequence, and as previously mentioned, the cylindrical bearing surfaces of the journal bearing and cone need not to be interrupted by recesses to receive balls or split rings. Furthermore, because of this larger bearing area between the journal bearings and cone, it is not necessary that the journal bearing have a "nose" bearing, as might otherwise be required. As also previously mentioned, this in turn makes it possible to devote at least substantially all of the adjacent end surfaces of the journal bearing and cone to absorbing thrust loads.

In the illustrated and preferred embodiment of the invention, the body has conduits which connect each chamber with the exterior of the body, each conduit having an outwardly facing seat intermediate its ends, and a plug is threadedly connected to each conduit outwardly of the seat. More particularly, the plug has a vent port therethrough with a seat on its inner end about the port, and a closure element is disposed between the seats to close the vent port and the conduit as the plug is moved inwardly to displace liquid which fills the chamber. Thus, the closure element is held off of the seat on the plug by means of a needle or the like extending through the vent port so as to permit liquid to pass outwardly therethrough as the plug is threaded inwardly within in the conduit. As also illustrated, each cone has a shaft which is inserted within a recess in the journal bearing as the cone is fitted over the bearing and the chamber is formed between the outer end of the shaft and the inner end of the recess with which the conduit connects. As a result, the liquid lock is formed between each cone and journal bearing without within the normal conbines of the bearing's exterior dimensions.

In accordance with another novel aspect of the present invention, first passageway means extends longitudinally between the cylindrical bearing surfaces of each journal bearing and the recess in the cone which fits over the bearing are connected with the second passageway means and which extend between adjacent ends of the journal bearing and cone recess, and means including a pump means connecting with the passageway means and is provided for circulating the lubricant therethrough in response to rotation of the cone. More particularly, the second passageway means are formed on opposite faces of a thrust bearing between the ends of the journal bearing and cone recess and connecting with an annular recess between the cone recess and the outer diameter of the thrust bearing with which the first passageway means connect.

As illustrated, the abovementioned shaft on each cone which extends into a recess in the journal bearing has an enlarged inner end which forms an annular pump chamber on the inner end of the enlarged end opposite the chamber on the opposite outer end therof which is filled with liquid to form a liquid lock holding the cone on the journal bearing, and a helical vane is fixed to one of the shaft and cone recess to displace lubricant in the pump chamber in response to rotation of the cone. Preferably, and as illustrated, the passageways of the first passageway means are formed in the upper side of the journal bearing, and thus away from the lower side which carries the load from the cone. More particularly, the first passageways of the first passageway means are enlarged intermediate their ends which connect respectively with a supply port connecting with the exterior of the bit body and the aforementioned annular recess so as to form a heat sink, which, in combination with the circulation of the lubricant within the passageways, lowers to a considerable extent the temperature of the lubricant. More particularly, in the illustrated and preferred embodiment, the shaft which extends into the recess in the journal bearing to form the pump chamber passes through a central opening in the thrust bearing and has means thereon which fits closely within the hole in the thrust bearing to hold it centered as well as openings therein connecting with the pump chamber with the second passageways formed in opposite faces of the thrust bearing.

In accordance with another novel aspect of the present invention, the lubricant is contained between the bearing surfaces of each cone and journal bearing by means which includes a generally triangularly shaped groove in the corner of the cone about the outer end of its recess, a seal ring of elastarmeric material in the corner of the recess, and a ring of carbon graphite or other suitable composite refractory metal disposed between the seal ring and inner end of the cylindrical surface of the journal bearing, the graphite ring and journal bearing having sealing surfaces which are curved about approximately 90° so as to maintain sealing engagement between them despite some longitudinal misallignment of the cone and journal bearing. More particularly, annular pads of deformable material are held between adjacent sides of the recess and the graphite ring to insure that the seal ring and graphite ring rotate with the cone, whereby the seal ring of is static and then much less prone to failure than dynamic seals formerly used for this purpose.

The bit body includes an upper body section adapted for connection to a drill string having a shank with a bore in one end, and hollow legs depending from the lower end of the shank, to connect the bore of the shank with its open end so that drilling fluid circulating downwardly through the drill string may be jetted through a jet nozzle in each leg toward the lower areas of the bit. The body also includes lower sections which are connected to the lower end of the shank and to one another in side by side relation and with the jet nozzle legs extending between them. More particularly, each lower body section includes a depending leg having an inwardly extending journal bearing therein to receive a cone for rotation thereabout. In this manner, the bit may be assembled without having to make difficult weld along the inner edges of the adjacent segments of the bit body, and since it is not necessary to weld along the shank, without having to prepare the shank prior to threading the same for attachment to the lower end of the drill string.

As illustrated, the upper ends of the lower body sections have interfitting parts which are closely received in a lower extension of the shank bore to hold them against lateral displacement, and a plug is disposed across and sealed within the bore extension above the innerfitting parts to divert drilling fluid into the nozzle legs.

Each of the cones which is rotatable about a journal bearing has carbide inserts which are mounted about the outer side of the body for cutting the bottom of a well bore as the cones rotate with and relative to the body of the bit. More particularly, in accordance with still another novel aspect of the present invention, each such insert is mounted has a conical surface on its inner end which is adapted to fit closely within a conical inner end of the hole in the outer side of the body and is held within its hole by a brazing material which forms a bond between their conical surfaces. More particurly, a preformed pellet of the brazing metal which is shaped to fit closely within the conical end of the hole is heated and an electrical potential is passed from the insert to the pellet of the cone to cause the pellet to soften and then be brazed to the conical surfaces of the hole and insert as the inner end of the insert continues to be moved into the pellet. More particularly, each such insert has a vent passage which permits gas to escape from the pellet as it is brazed to the cone and insert.

Lubricant is supplied to the bearing surfaces of the cone and journal bearing by means which includes a reservoir for the lubricant leading to the first passageway means, an opening in the body which connects the reservoir with the outside of the body, and a piston which is sealably slidable in the reservoir and which is urged towards the reservoir by well fluid. In accordance with another novel aspect of the present invention, and as compared with the prior art, a charge of gas intermediate the piston and lubricant in the reservoir is maintained at a pressure some what higher than that of the ambient well fluid. More particularly, a means is formed in the piston to permit the charge to be injected into the space between the piston and the reservoir upon filling of the reservoir with liquid and movement of the piston into the body opening.

In the drawings, wherein like numerals are used throughout to indicate like parts:

Figure 1:
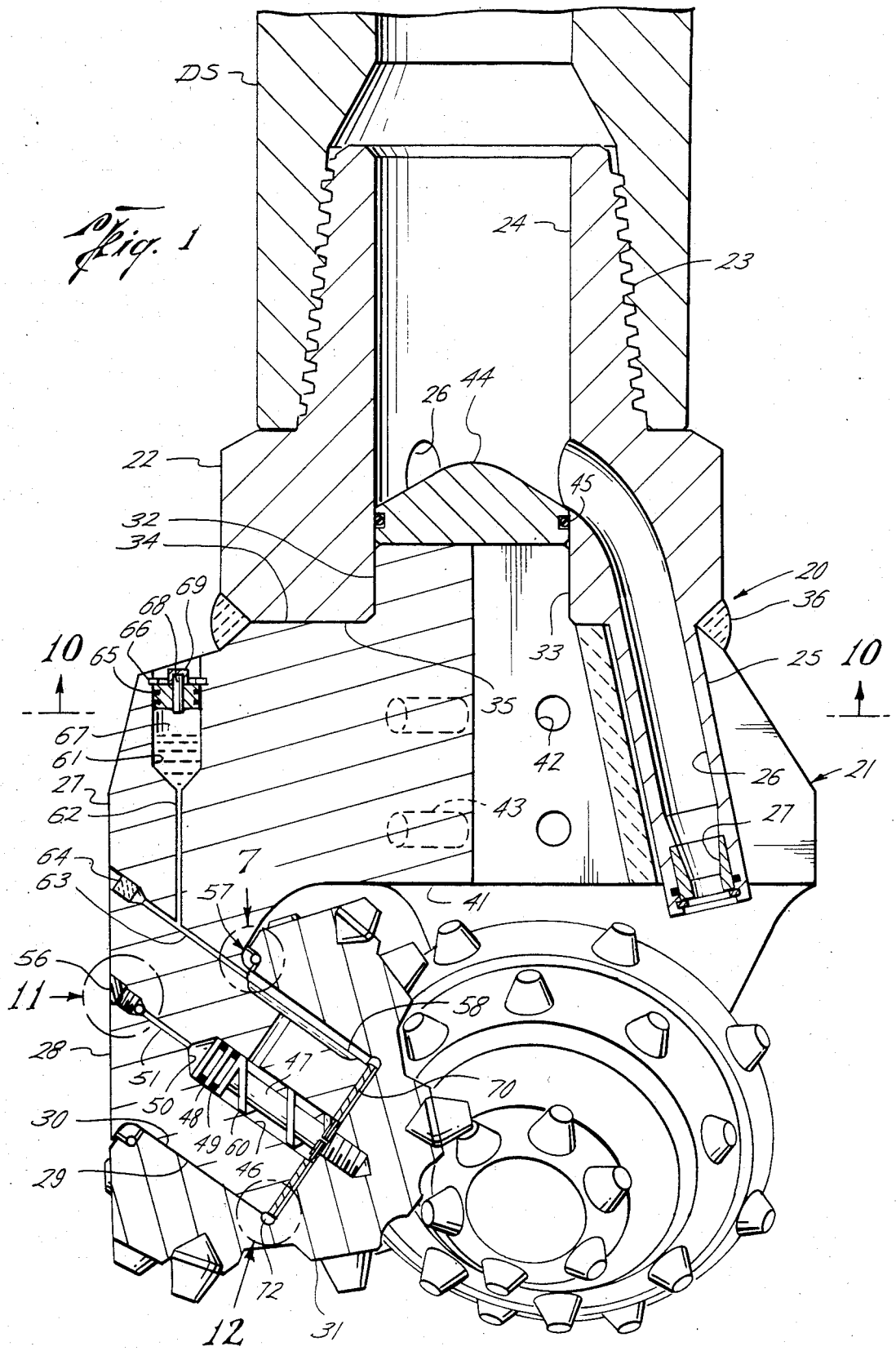
FIG. 1 is a vertical sectional view of a bit constructed in accordance with the present invention and having the upper threaded end of its shank connected to the lower end of a rotary drill string.
Figure 2:
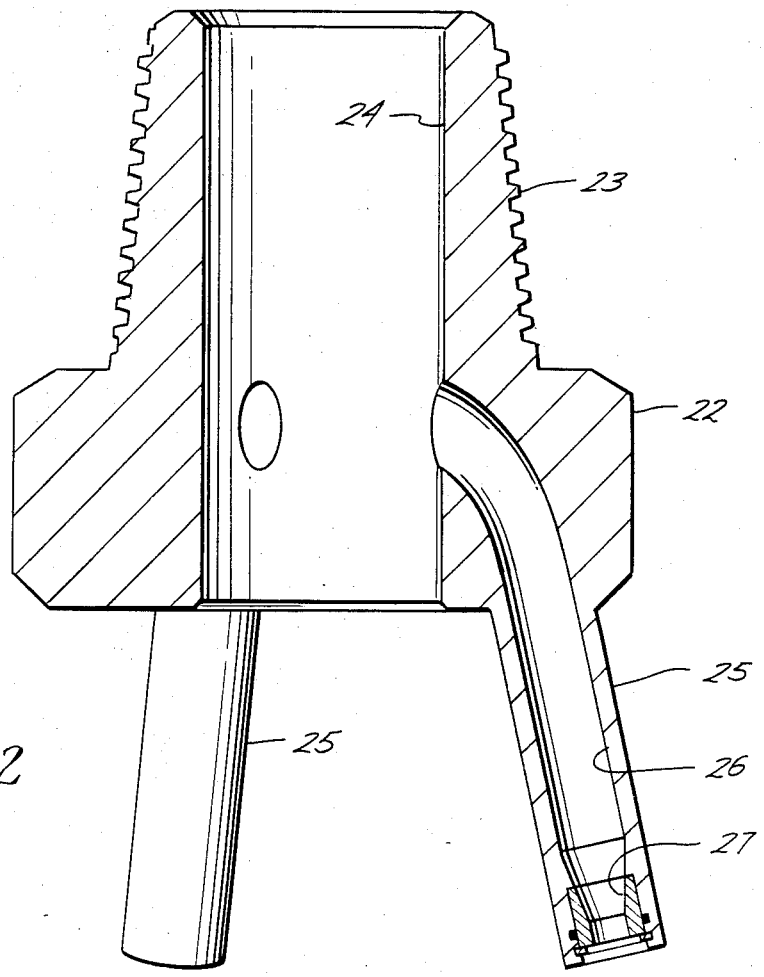
FIG. 2, is a vertical sectional view of the upper section of the body of the bit of FIG. 1 removed from connection with the lower end of the drill string.
Figure 3:
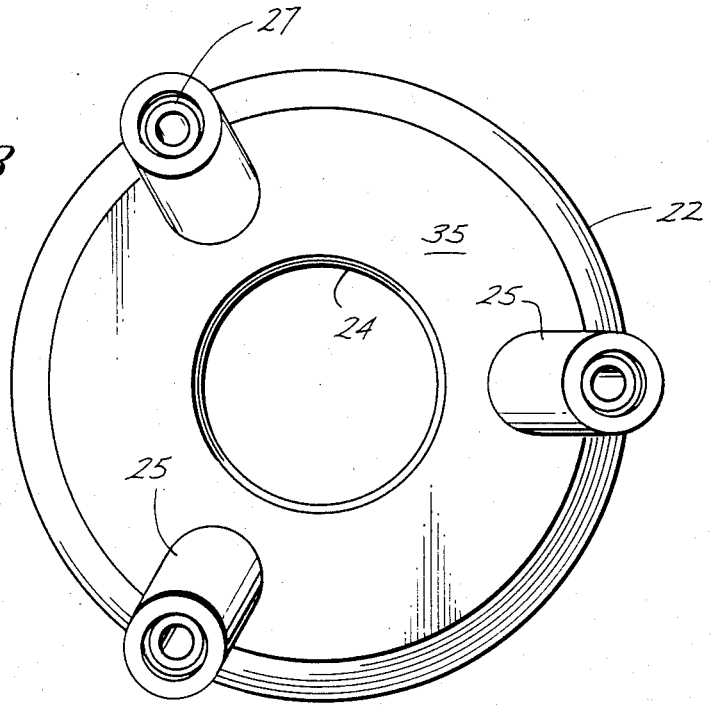
FIG. 3 is a lower end view of the upper body section of FIG. 2.

With reference now to the details of the above described drawings, the overall bit, which is indicated in its entirety by reference character 20 in FIG. 1, comprises a body at 21 which includes a shank 22 having a threaded upper end 23 connected to the lower end of a drill string DS and having a bore 24 in its upper end forming a lower continuation of the bore through the drill string. The upper body 22 of the drill bit body also includes three hollow legs 25 which depend from the lower end of the shank in generally equally spaced apart relation to connect the bore 25 in the shank with their open lower ends, A jet nozzle 27 is releasably mounted within the lower end of the hole 26 through each leg so that drilling mud which is circulated downwardly through the drill string may be jetted toward a desired area of the bit.

Figure 10:
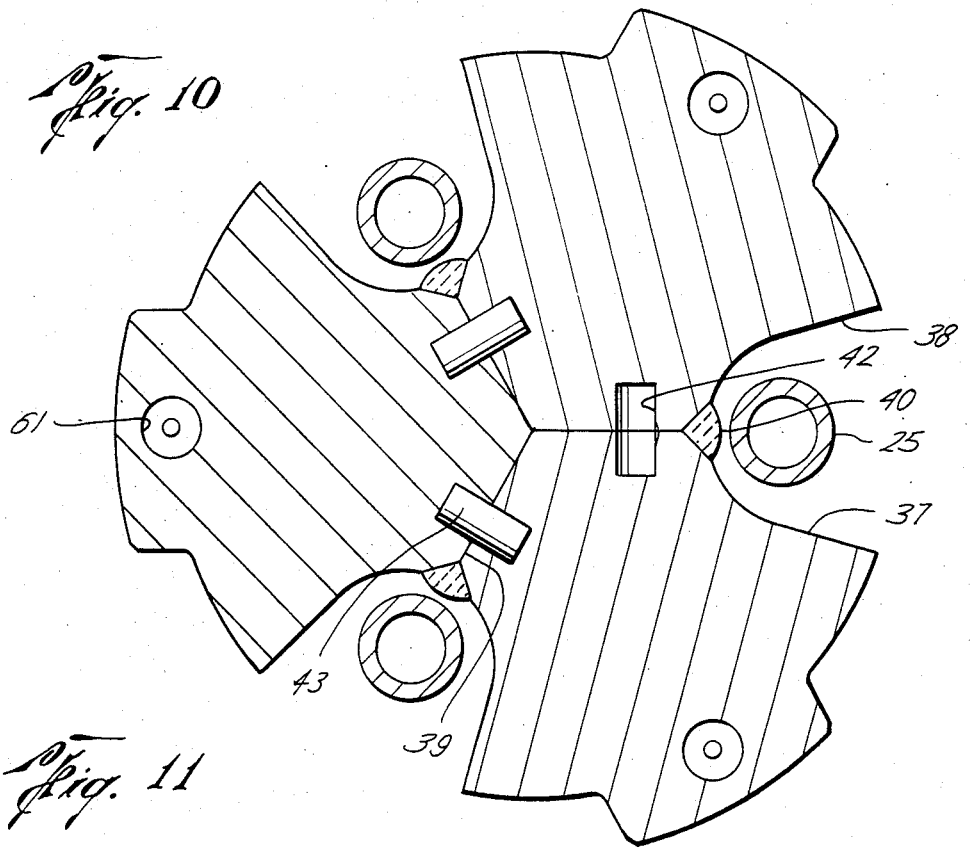
FIG. 10 is a cross sectional view of the lower body sections, as seen along broken lines 10—10 of FIG. 1, and showing the extension of the nozzle legs of the upper body between adjacent sides of the lower body sections.

The bit body 21 also includes three lower sections 27 which are connected to the lower end of the shank and to one another in side by side relation, with the nozzle legs 25 extending between the sides of the upper ends adjacent body sections 27, as best shown in FIG. 10. More particularly, each such lower section 27 of the bit body has a depending leg 28 and a generally inwardly and downwardly extending journal bearing 29 thereon and about which a cone 31 is rotatable. The upper end of each section 27 has a neck portion 32 which, together with the neck portions of the other lower body sections, forms a cylindrical boss which fits closely with a lower extension 33 of the bore 24 of the shank. More particularly, shoulders 34 on the upper ends of the lower body sections are adapted to abut the lower end 35 of the shank, and the adjacent outer end edges of the shoulders and lower end of the shank are chamfered to receive a peripheral weldment 36 connecting the lower body sections to the upper body section. As best shown in FIG. 10, the outer edges of the adjacent inner ends of the sides of the lower body sections are also chamfered to receive a longitudinal weldment 40 between them.

Figure 9:
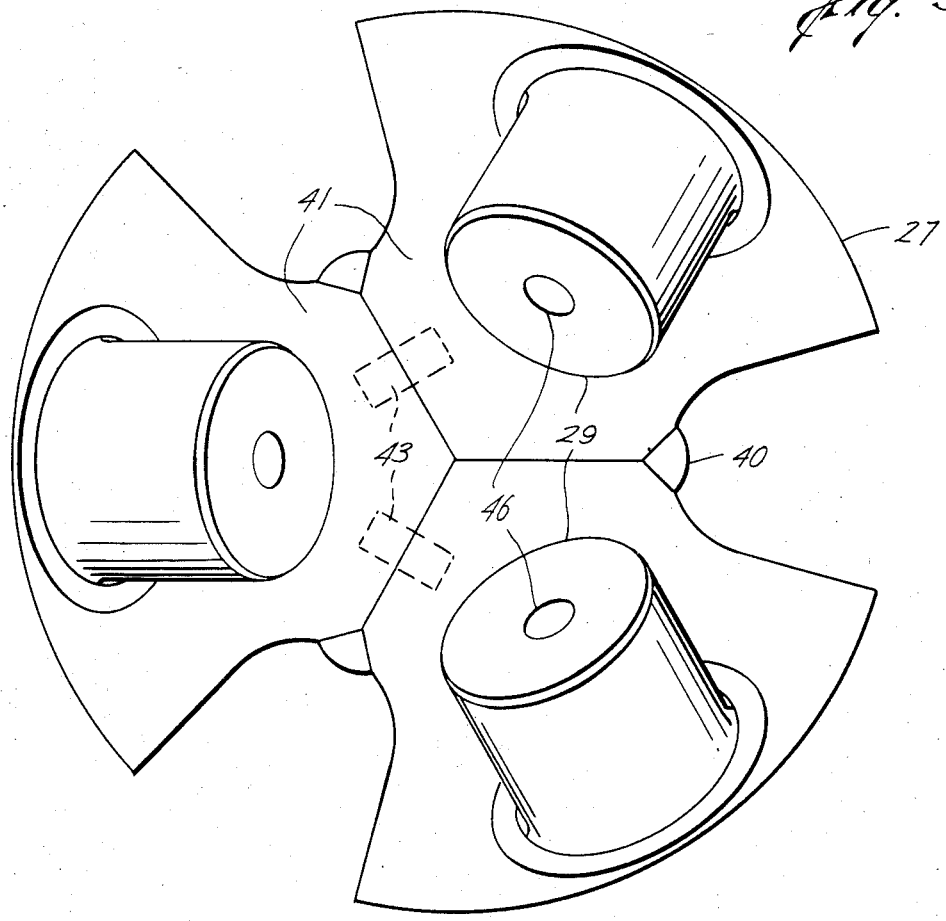
FIG. 9 is a view of the lower end of the assembled lower body sections of FIG. 8.

As ,shown in FIGS. 9 and 10, the outer ends of the sides of the adjacent lower body sections are flared at 37 to form a recess 38 extending lengthwise thereof to receive the nozzle legs 25 between them, and the lower ends 41 of the upper portions of the lower body sections are disposed above the cones 31 received on the journal bearings. Holes 42 are formed in the abutting sides 39 for alignment with one another to receive pins dowel pins 43 which hold the sections in vertically side by side relation. Thus, during assembly of the bit body, two of the lower body sections 27 are moved into interfitting relation by means of two vertically spaced dowel pins received within aligned holes in their sides, and the third body section is then moved into position by disposing its holes 42 over the ends of the dowel pins on one of the previously connected sections, the holes 42 between the last connected and the other of the first two connected sections being empty.

A plug 44 is disposed within the bore extension 33 of the shank and has an "O" ring 45 carried thereabout for sealably engaging the extension and thereby combine drilling fluid within the bore 24 for flow into and through the hollow nozzle legs 27. More particularly, and as shown in FIG. 1, the upper side of the plug is generally conically shaped to direct the flow of the drilling fluid evenly to the three nozzles.

Each journal bearing pin has a recess 46 formed in its outer end to receive a shaft 47 threadedly connected to the end of the recess 30 in each cone 31 as the cylindrical surface of the cone recess is moved over the cylindrical outer diameter of the journal bearing. An enlarged outer end 48 of the shaft 47 carries seal rings of 49 which are sealably engageable within the recess 46 to divide it into an inner annular chamber about the shaft between the inner end of the head 48 and the end of the cone recess and an outer chamber intermediate to the outer side of the head 48 and the end of the recess 46 in the journal bearing.

Figure 11:
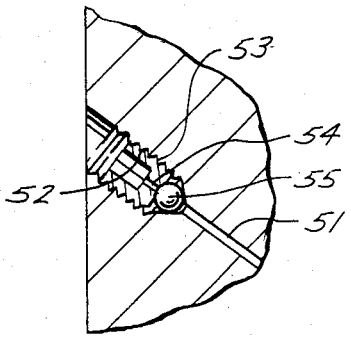
FIG. 11 is an enlarged sectional view of the plug in the conduit of the bit body leading to the liquid lock chamber, as shown at number "11" in FIG. 1, and illustrating the vent port and closure member therethrough.

More particularly, the end wall 50 of the journal bearing recess connects with a conduit 51 leading to the outer side of the shirtail of the leg 28 from which the journal bearing extends. As shown in FIG. 11, the outer end of the conduit 51 is enlarged at 52 to form a seat about conduit 51 and threaded to receive a plug 53 which in turn has a vent port 54 formed therethrough. More particularly, and as previously described, a closure element in the form of a ball 55 is disposed between a seat on the inner end of the vent port 54 and the seat formed in the conduit 51.

The cone is held on the journal bearing over which it fits by liquid which fills the outer chamber and from which air has been exhausted upon displacement of the liquid through the port in the plug 53 as it is moved inwardly within the threaded conduit 52. As also previously described, the ball 55 is held off the seat on the inner end of the vent port by means of a needle (not shown) inserted through the vent port as the plug is moved inwardly. Thus, liquid within the chamber may flow past the ball and through the vent port until the inner end of the ball is held tightly between the seats on the plug and conduit following which the needle may be withdrawn. Thus, air-free liquid is captured within the chamber and the conduit which forms a liquid lock to hold the cone on place on the journal bearing.

Figure 4:
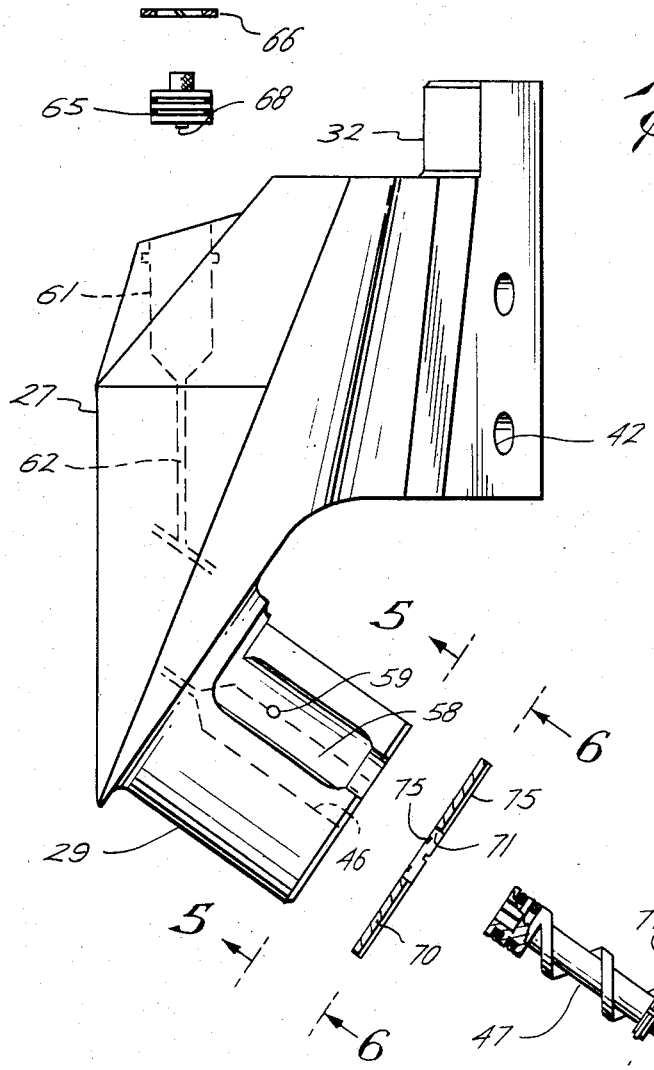
FIG. 4 is a side view of one of the lower sections of the body of the bit, removed from connection with the upper body section, prior to assembly of the cone on the journal bearing thereof, and with the thrust bearing and shaft on the cone for fitting within the recess in the journal bearing being shown in exploded positions with respect to the bearing.

As shown in FIG. 11, the outer end of the plug 53 has a noncircular recess to receive a suitable tool for moving it into and out of the threaded end 52 of the conduit. When the plug is in place upon filling of the outer chamber in the journal bearing with liquid, a stopper 56 (see FIG. 1) may be moved into place to seal off the outer end of the conduit in the event there might be leakage past the plug. As shown in FIG. 4, the outer end of the enlarged head of the shaft 47 also has a noncircular recess to receive a suitable tool for connecting it to a cone.

More particularly, when the cone is held in place on the journal bearing, a seal assembly 57 carried within a groove on the outer end of the cylindrical recess 30 in the cone sealably engages a sealing surface about the intersection of the inner end of the journal bearing with the inner side of the leg 28 from which it extends. This seal assembly, which will be described in more detail to follow, seals off passageways through which lubricant is circulated between the cylindrical bearing surfaces of the journal bearing and its cone during rotation of the cone about the journal bearing.

Figure 5:
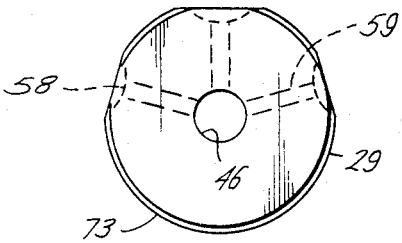
FIG. 5 is an end view of the journal bearing, as seen along broken lines 5—5 of FIG. 4.
Figure 4A:
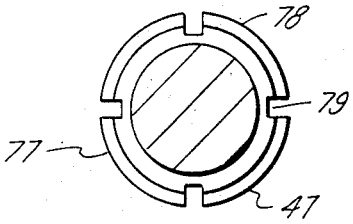
FIG. 4A is an enlarged cross sectional view of the shaft, as seen along broken lines 4A—4A of the exploded portion of FIG. 4.

As previously described, a first set of passageways through which the lubricant circulates are shown at 58 to comprise recesses formed in the outer bearing surface of the journal bearing and extending longitudinally in spaced apart relation on the upper side of the bearing surface. More particularly, each such passageway 58 connects intermediate its upper and lower ends with lateral passageways 59 leading to the pump chamber formed between the inner end of the enlarged head 48 of the shaft 47 and the inner end of the recess in the cone, and the outer ends of the passageways 58 are flat, as best shown in FIG.5, to connect with laterally extending second passageways 59 between the end of the journal bearing and the end of the recess in the cone and leading to the opposite end of the pump chamber.

More particularly, a helical vane 60 is mounted about the shaft 47 for rotation within the pump chamber, so that as the cone rotates in a clockwise direction, as seen in a direction looking from the journal bearing downwardly, the lubricant is caused to circulate downwardly through the pump chamber, laterally outwardly through passageways between the ends of the cone and recess and then upwardly through the longitudinal passageways 58 for return through to the pump chamber through the lateral suction passageways 59. More particularly, and as shown, the longitudinal passageways 58 are deep intermediate their upper and lower ends to provide heat sinks which further contribute to reducing the temperature of the lubricant.

Lubricant is supplied to the above described passageways and pump chamber from a reservoir 61 formed in the lower body section 27 and connected to the upper end of one of the passageways 58 by means of a vertically extending port 62 depending from the lower end of the reservoir and a downwardly and inwardly extending port 63 connecting with the upper end of the middle passageway 58. Lubricant may be supplied to the reservoir and the passageways through an opening connecting the port 63 to the upper shirttail of the the leg 28, and closed by means of a plug 64.

As shown in FIG. 1, the upper end of the reservoir 61 is closed by means of a piston 65 sealably disposed within the reservoir and held down by means of a snap ring 66, and is filled with lubricant to a level below the lower open end of the piston. A chamber 67 formed between the reservoir and the lower side of the piston 65 is filled with nitrogen at a pressure which is somewhat higher than that of the well fluid which acts against the upper side of the piston. The chamber 67 is adapted to be filled with nitrogen or other gas through a valve plug 68 extending through the piston 66 and closed, upon filling, by means of a cap 69 across its outer end.

Figure 12:
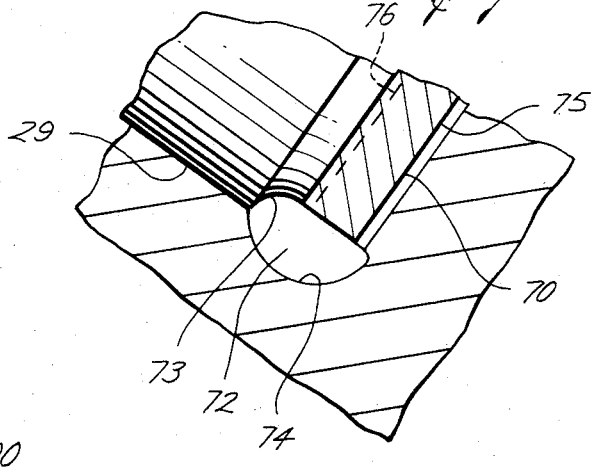
FIG. 12 is a further enlarged sectional view of the annular recess between the outer end of a journal bearing and the inner corner of a cone recess in which it is received, as seen at number "12" in FIG. 1.

A thrust bearing 70 disposed between the lower end of the journal bearing and the inner end of the recess of the cone has a central hole 71 through which the shaft 47 on the cone extends, and an outer diameter which is of somewhat lesser diameter than the bearing surface of the journal bearing and spaced from the inner diameter of the cone recess by an annular passageway 72. More particularly, and as shown in FIG. 12, the inner end of the cone recess has a curved outer wall 73 and the corner of the journal bearing adjacent to its inner end has a quarter round 74 so that, with the outer diameter of the thrust ring 70 substantially aligned with the reduced diameter inner end of the journal bearing, the passageway 72 permits the free flow of lubricant between longitudinally extending passageways 58 between the cylindrical surfaces of the journal bearing and cone recess and the lateral suction passageways 59 between the inner ends.

Figure 6:
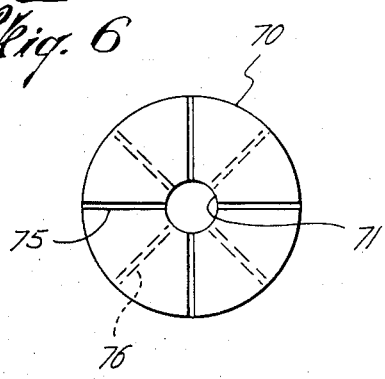
FIG. 6 is a view of the outer face of the thrust bearing shown in the exploded portion of FIG. 4, and as seen along broken lines 6—6 thereof.

As shown in FIG. 6, these laterally extending passageways 75 and 76 are formed in the opposite faces of the thrust bearing and extend radially outwardly from the hole 71 to the recess 72 so as to permit lubricant to pass radially either between the lower end of the journal bearing and the opposite face of the thrust bearing or between the end of the recess in the cone and the opposite face of the thrust bearing. As shown, the passageways on opposite sides of the thrust bearing are staggered in a circumferential sense. The thrust bearing may be made of berrelium copper, or, if desired, a composite refractory metal such as $MoS_2$.

The thrust bearing is held in a position of alignment with the longitudinal axis of the thrust bearing by means of an enlargement 77 formed on the portion of the shaft 47 which extends through the hole 71 in the thrust bearing. As shown in FIG. 4, the mid portion of the enlargement 77 has an outer diameter 78 which fits closely within the hole 71, and slots 79 are formed in the enlargement 77 to permit lubricant to flow from the pump chamber into the hole 71 in the thrust bearing and thus radially outwardly through slots 75 and 76 into the annular recess 72 and thus into the longitudinal passageways 58. The thrust bearing 70 may be found to rotate with the cone, and thus with respect to the journal bearing, or alternatively may be held against rotation with respect to the thrust bearing, so that the cone rotates with respect to it.

Figure 7:
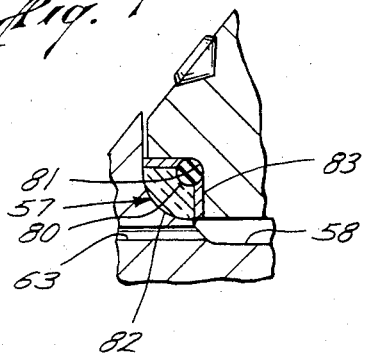
FIG. 7 is an enlarged detailed cross sectional view of the seal assembly between the outer end of the cone recess and the inner end of the journal bearing, as indicated by the encircled portion designated by the number "7" in FIG. 1.
Figure 8:
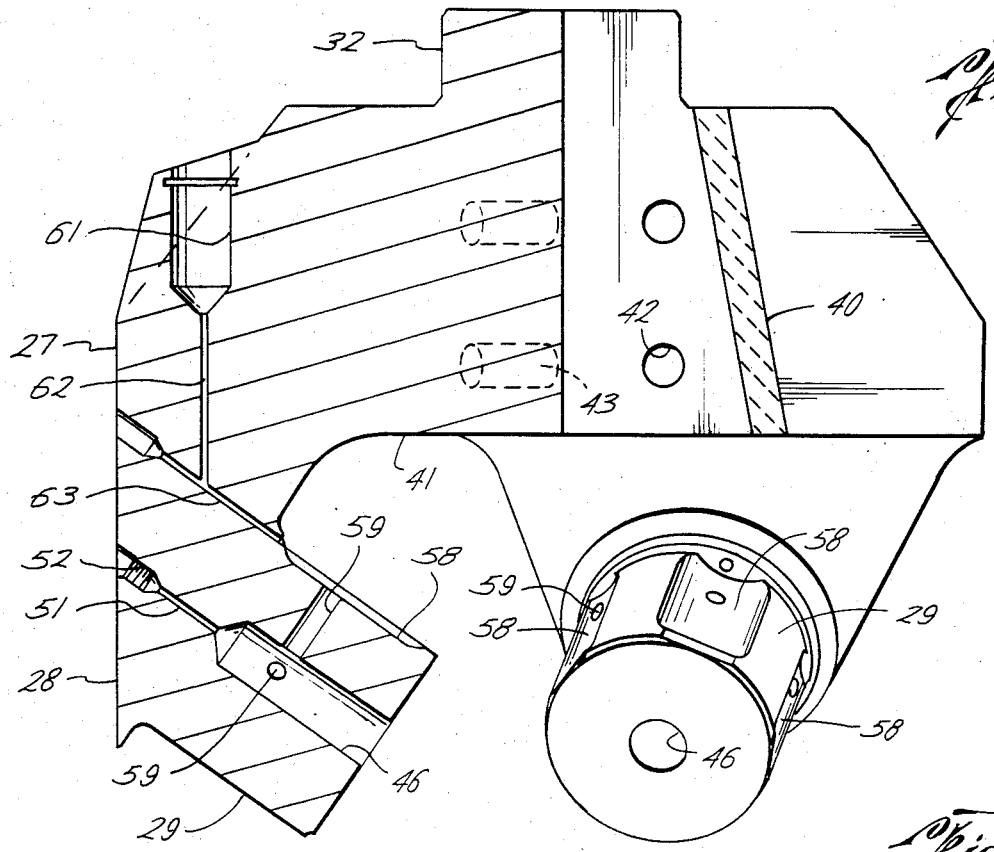
FIG. 8 is a vertical sectional view of the lower body sections of the bit, when connected to one another, but with the cones removed therefrom for purposes of illustration.

The seal assembly 57 is best shown in FIG. 7 to comprise an O-ring 80 of elastameric material disposed within a triangularly shaped groove 81 formed at the intersection of the inner diameter of the recess of the cone with the end of the cone opposite a sealing surface about the intersection of the journal bearing 29 extends. More particularly, the seal assembly also includes a ring 82 of carbon graphite or other composite refractory metal such as $MoS_2$ disposed between the O-ring 81 and sealing surface, and, as shown in FIG. 7, the outer wall of the graphite ring and the opposite sealing surface of the journal bearing against which it is sealably engaged form quarter rounds which enable some misallignment of the longitudinal axis of the journal bearing and cone without damage to the seal assembly. The sealing surface is ground and lapped to fit the graphite ring.

The seal assembly also includes annular pads 83 of rubber of other deformable material disposed between the sides of the groove and the oppositely facing sides of the graphite ring 82 disposed opposite thereto. More particularly, the pads are pressed between them to form a frictional grip which prevents the ring 82 from rotating with respect to the cone, and in turn prevents the seal ring 81 from rotating with respect thereto. Consequently, a wear surface of the seal assembly is formed of non-elastermeric meterial, and the elastermeric ring thereof is static and thus less susceptible to wear than would be a dynamic seal.

Figure 13:
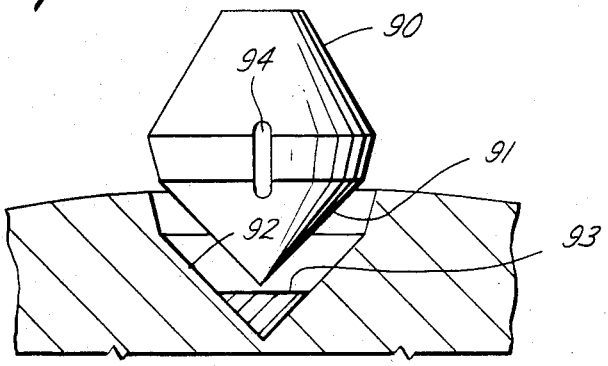
FIG. 13 is an enlarged sectional view of a hole in the outer surface of a cone, and a carbide insert as it is moved into the hole for engaging the body of brazing metal therein.

As shown in FIG. 13, at least certain of these inserts 90 mounted about the wear surfaces of the cone have inner conical ends 91 adapted to be received closely within the similarly shaped inner ends of holes in the cone. More particularly, a pellet 93 of brazing material such as nickel, which has a conical shape adapted to fit closed within the conical end 92 of the hole in which the insert is to be imbedded is adapted to be heated, and an electrical potential is connected across the insert and the cone, with its positive end connected to the insert in its negative end connected to the cone, so as to soften the pellet 93 as the lower pointed end of the insert 91 is moved into contact therewith. As the insert is then moved fully into the hole, the brazing material and gases which it releases are permitted to escape between the hole and the insert through one or more slots 94 formed in the side of the insert. As shown, the outer end of the hole and an intermediate portion of the recess are formed with surfaces above the conical portions which stabilize the insert when brazed to the cone in the manner described.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A drill bit, comprising a body having an upper end for connection to a rotary drilling string and legs depending from its lower end, a journal bearing extending inwardly from each leg, a cone fittable over the end of each bearing for rotation thereabout, means forming a chamber between the walls of each bearing and cone, a liquid filling said chamber from which air has been displaced, and means seating said chamber, said sealing means including means on said cone and said hournal bearing sealing therebetween, said chamber being sealed to prevent leakage of air in or liquid out of the chamber to form a liquid lock which holds the cone on the bearing while permitting relative rotary movement between said cone and bearing and preventing any substantialy longitudinal movement between said cone and bearing.

2. A drill bit according to claim 1, in which said body has conduits connecting each chamber with the exterior of said body, each conduit having a seat intermediate its ends, said chamber sealing means comprising a plug threadedly connected to each conduit and having a vent port and conduit therein and a seat on its inner end about said port, and a closure element disposed between said seats on said plug and conduit to close said vent port and conduit as said plug is moved inwardly to displace the liquid which fills said chamber.

3. A drill bit according to claim 2, in which said cone has a shaft inserted within a recess in said bearing as said cone is fitted thereover, and said chamber is formed between the end of said shaft and the end of said recess.

4. A drill bit according to claim 1 in which each said cone having a cylindrical recess mounted for rotation about a cylindrical surface of said journal bearing, additionally including means forming interconnected first passageway means extending longitudinally between the cylindrical surfaces of each journal bearing and oone recess and second passageway means between the adjacent ends of said journal bearing and cone recess, and means including pump means connecting with said passageway means for circulating lubricant therethrough in response to rotation of said cone.

5. A drill bit according to claim 4, including a thrust bearing between the ends of each journal bearing and cone recess, said second passageway means being formed in the opposite faces of said thrust bearing and connecting with an annular recess which is formed between said cone recess and outer diameter of said thrust bearing and which connects with said first passageway means.

6. A drill bit according to claim 4, including a shaft on each cone having an enlarged end extending into a recess in said journal bearing to form an annular pump chamber therebetween on one end of said shaft enlargement having one end connecting with said first passageway means and said other end with said second passageway means, and helical vanes in said pump chamber fixed to one of said journal bearing and shaft.

7. A drill bit according to claim 6, in which said first named chamber is between said other end of said shaft enlargement and said end of said recess in said journal bearing and is filled with liquid to form said liquid lock holding said cone on said thrust bearing.

8. A drill bit according to claim 6, including a thrust bearing between said ends of each journal bearing and cone recess and having a hole through which said shaft extends, said second passageway means being formed in the opposite faces of said thrust bearing and having outer ends connecting with an annular recess which is formed between said cone recess and outer diameter of said journal bearing and which connects with said first passageway, and said thrust bearing having openings which connect said pump chamber with the inner end of each passageway of said second passageway means.

9. A drill bit according to claim 4, wherein said first passageway means is formed in the upper side of said cylindrical surface of each journal bearing.

10. A drill bit according to claim 9, wherein each passageway of said first passageway means is enlarged intermediate its ends to form a heat sink.

11. A drill bit according to claim 1 including a generally triangular groove in said cone about the outer end of its recess, a seal ring of elastomeric material in the corner of said groove, and a ring of carbon graphite or other composite refractory metal disposed between said seal ring and an annular surface of said inner end of said journal bearing opposite said groove, said graphite ring and annular surface being curved above the axis for approximately ninety degrees in order to maintain sealing contact therebetween despite axial misalignment of said bearing and cone, and annular pads of deformable material held between the adjacent sides of each groove and graphite ring to insure that said sealing and graphite rings rotate with said cone.

12. A drill bit according to claim 1 in which said body including an upper section having a shank adapted for attachment to a drill string and a bore through the upper end of said shank, hollow legs depending from the lower end of said shank and a hole therein connecting the bore of said shank with its lower end and a jet nozzle in said hole, whereby drilling fluid circulated downwardly through said drill string may be jetted toward desired areas of said bit, and lower sections which are connected to said lower end of said shank and to one another to side by side relation and with said legs on the lower end of said shanks extending between them, each lower body section including a depending leg having an inwardly extending journal bearing, and said cones each mounted for rotation about said journal bearings on said hollow legs.

13. A drill bit according to claim 12, in which said upper end of said lower body sections have interfitting parts closely received in a lower extension of said shank bore to hold them against lateral displacement, and a plug is disposed across and sealed within said bore extension above said interfitting parts to direct drilling fluid into said hollow legs.

14. A drill bit according to claim 12, in which all but one of said legs is located in side by side relation with adjacent legs by laterally extending dowel pins.

15. A drill bit according to claim 1 in which each said cone comprises a body having a recess thereon fittable over the journal bearing on the leg of said bit body for rotation thereabout, carbide inserts mounted about the outer side of said cone body for cutting the bottom of a well bore of as said cone rotates with and relative to said bit body, each said cone body having holes in its outer side each of which has a conical end, and each insert having a conical surface on its inner and fitting closely within the conical inner end of a hole in said body and being held therein by brazing metal which is caused to bond said insert and cone body as said conical end of insert is moved into engagement with a pellet of the material shaped to fit within the conical end of the hole and electrical current is passed between said insert and cone body to melt said pellet and thus permit said conical end of said insert to be moved toward said conical seat of said cone body.

16. A drill bit according to claim 1 in which each said cone having a cylindrical recess mounted for rotation about a cylindrical surfaces of said journal bearing, a reservoir for the lubricant, means sealing between said cone and journal bearing to contain the lubricant between said cylindrical bearing surfaces of said cone and journal bearing, an opening connecting said reservoir with the outside of said body, a piston sealably slideable in said opening and urged toward said reservoir by well fluid, and a charge of gas contained between said piston and lubricant within said reservoir at a pressure higher than the anticipated pressure of the well fluid.

17. A rotary tool comprising a supporting body, a tool member supported for rotation on said supporting body, means forming a chamber between the walls of said supporting body and tool member, a liquid filling said chamber from which air has been displaced, and means sealing said chamber, said sealing means including means on said tool member and said supporting body sealing therebetween, said chamber being sealed to prevent leakage of air in or liquid out of the chamber to form a liquid lock which holds the tool member on the supporting body while permitting relative rotary movement between said tool member and supporting body and preventing any susbstantial longtudinal movement between said tool member and supporting body.

* * * * *